United States Patent [19]

Shaffer et al.

[11] Patent Number: 4,478,415

[45] Date of Patent: Oct. 23, 1984

[54] ENCAPSULATED BASKETBALL BACKBOARD

[75] Inventors: Dale A. Shaffer, Lebanon; John W. Kay; Maurice H. Basquin, both of Frankfort, all of Ind.

[73] Assignee: Harmeson Manufacturing Co., Inc., Frankfort, Ind.

[21] Appl. No.: 397,827

[22] Filed: Jul. 13, 1982

[51] Int. Cl.[3] ..... A63B 63/08

[52] U.S. Cl. ..... 273/1.5 R; 52/309.15; 52/802

[58] Field of Search ..... 273/1.5 R, 82 R; 52/802, 805, 811, 809, 782–785, 791, 309.13–309.15

[56] References Cited

U.S. PATENT DOCUMENTS

| | | | |
|---|---|---|---|
| 1,789,363 | 1/1931 | Gross | 273/1.5 R |
| 3,287,854 | 11/1966 | Dasovic et al. | 52/802 X |
| 3,390,881 | 7/1968 | Senne | 273/82 R UX |
| 3,450,593 | 6/1969 | Fossier et al. | 52/805 X |
| 3,606,508 | 9/1971 | Burnes | 52/783 X |
| 3,616,140 | 10/1971 | Copeland et al. | 273/82 R UX |
| 3,669,450 | 6/1972 | Mason . | |
| 3,820,784 | 6/1974 | Boitano et al. . | |
| 3,858,877 | 1/1975 | Lundstrom | 273/6 X |
| 3,970,304 | 7/1976 | Ebstein et al. . | |
| 4,005,860 | 2/1977 | Ebstein et al. . | |
| 4,009,916 | 3/1977 | Fantoni | 52/785 X |
| 4,083,743 | 4/1978 | Degens . | |
| 4,158,712 | 6/1979 | Degens . | |
| 4,201,819 | 5/1980 | Schenz . | |

FOREIGN PATENT DOCUMENTS

| | | | |
|---|---|---|---|
| 678483 | 10/1964 | Italy | 52/802 |

OTHER PUBLICATIONS

Jamison Mfg. Co. Catalog, pp. 361–765, 2–1966, Backboards, Nos. 361–765 & 361–786.

*Primary Examiner*—Paul E. Shapiro

*Attorney, Agent, or Firm*—Lowe King Price & Becker

[57] ABSTRACT

A basketball backboard includes a substrate core member fabricated from reconstituted wood products bonded together with a water resistant resin to form a substantially rigid core structure. A first plastic shell member including a flat first portion corresponding to the front surface of the substrate is integrally formed with depending peripheral edges positionable to cover corresponding peripheral edges of the substrate in contacting engagement when bonded thereto. The plastic shell partially covering the substrate core assists in minimizing moisture penetration into the substrate. A second plastic shell can be provided to cover the rear surface of the substrate core to completely encapsulate the core.

10 Claims, 5 Drawing Figures

ENCAPSULATED BASKETBALL BACKBOARD

TECHNICAL FIELD

This invention generally relates to basketball backboards and, more particularly, to a basketball backboard encapsulated in protective plastic coatings.

BACKGROUND ART

Commercially available basketball backboards are typically used in outdoor environments, in playgrounds and above garage doors, for example, to support a basketball hoop and net mounted on one side thereof. Such backboards are conventionally formed from rigid materials, such as plywood, fiberglass, metal, composition board and the like. Mounting holes drilled through the backboard enable attachment to an upright support structure with brackets.

To be practical for home use, a basketball backboard must be relatively inexpensive to purchase and thereby economical in design. Unfortunately, backboards formed from solid fiberglass, metal and like, solid, constructive materials are generally too expensive for the average family, resulting in consumer tendencies to purchase the plywood and composition board models.

In outdoor environments, basketball backboards are constantly exposed to harsh weather conditions, such as wind, rain, snow and sleet. Unfortunately, plywood and composition board models easily absorb and retain moisture, which has a deteriorating effect on their structural integrity and appearance, resulting in warping and possible fracturing, thereby requiring frequent replacement. The present invention provides a basketball backboard which overcomes these disadvantages.

SUMMARY OF THE INVENTION

It is accordingly an object of the present invention to provide a basketball backboard of improved structural integrity that is essentially moisture-proof and resistant to warping and breakdown.

Another object of the invention is to provide a basketball backboard that can be economically manufactured and is capable of reliable operation in outdoor use.

A still further object is to provide a basketball backboard capable of retaining an attractive appearance in outdoor environments over extended periods of time.

DISCLOSURE OF THE INVENTION

A basketball backboard, according to the invention, comprises a substrate core member formed of substantially flat, rigid material of generally rectangular configuration having corresponding front and rear surfaces and peripheral edges therebetween. A plastic shell member is provided and includes a first portion corresponding to the front surface of the substrate core and second edge portions integrally formed and peripherally depending from the first portion and corresponding to the peripheral edges of the substrate core. An adhesive bonding resin is applied to fasten the plastic shell member to the substrate core. In bonded engagement, the first portion and the second edge portions of the shell are respectively juxtaposed and in contact with the front surface and the peripheral edges of the substrate core to prevent moisture penetration through the shell and to improve structural rigidity.

The substrate core member is preferably formed from a material consisting of reconstituted wood products having wood chips and the like bonded together with a water resistant resin forming the substantially rigid core. The plastic shell member is generally rigid and is preferably formed from plastic material selected from the group consisting of polystyrene, polycarbonate, polyacrylate, polyethylene and polypropylene. The plastic shell member is of sufficient thickness to prevent telegraphing of depressions and protuberances appearing in the outer surface of the substrate core to the outer surface of the plastic shell member.

In a second embodiment, a second plastic shell member is provided to cover the rear surface of the substrate member. The second shell member includes a first portion generally corresponding to, in a slightly larger size than, the rear surface of the substrate core. Second edge portions peripherally depend from the first portion. The first portion of the second shell is attached directly to the rear surface of the substrate core, resulting in overlapping placement of the second shell edge portions on the first shell edge portions and in sealing engagement to completely encapsulate the substrate core and isolate same from the external environment. In the unlikely event that moisture enters and is absorbed by the substrate core, causing swelling, the first and second plastic shells can expand away from each other along their juxtaposed second edge portions, to prevent warping of the basketball backboard while maintaining the structural integrity thereof.

A method of manufacturing the basketball backboard of the invention is also disclosed. According to the method of the invention, the substrate core material is first formed into a generally rectangular basketball backboard configuration. An adhesive means is then applied to the front surface of the formed substrate with a glue spreader. The plastic shell is positioned in contacting engagement with the front surface and the peripheral edges of the substrate. Cold pressing is then performed on the plastic shell against the substrate for a predetermined time to allow the adhesive means to cure in adhesive bonding engagement with the substrate and the plastic shell.

Still other objects and advantages of the present invention will become readily apparent to those skilled in this art from the following detailed description, wherein have been shown and described only the preferred embodiments of the invention, simply by way of illustration of the best mode contemplated of carrying out the invention. As will be realized, the invention is capable of modifications in various obvious respects, all without departing from the invention. Accordingly, the drawings and description are to be regarded as illustrative in nature, and not as restrictive.

DETAILED DESCRIPTION OF THE INVENTION

Figure 1:
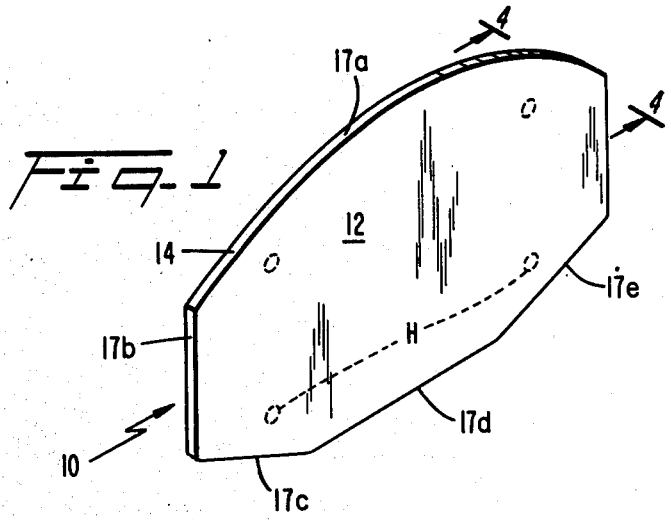
FIG. 1 is a perspective view of the basketball backboard of the present invention.
Figure 2:
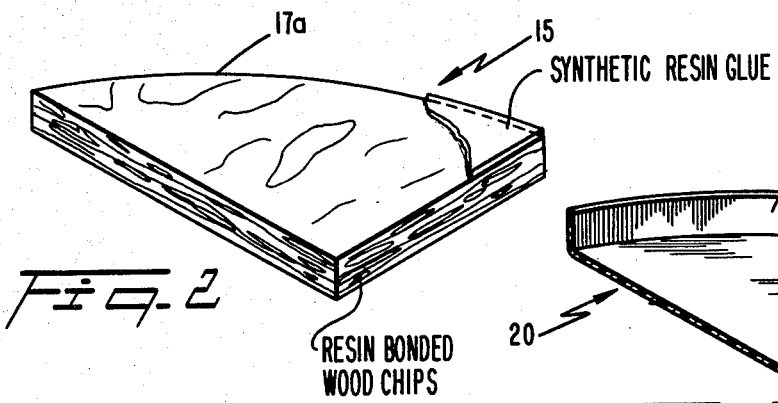
FIG. 2 is a partial perspective view of a section of the substrate core member of the invention.

Referring to FIG. 1, a basketball backboard of the invention, generally designated with reference numeral 10, is of conventional shape and includes a front surface 12 and a rear surface 14. A basketball net and hoop (not shown) are operatively mounted upon front surface 12 with screws or the like. A pair of mounting holes H extending through backboard 10 enable supporting placement of the backboard on an upright support structure with suitable bracket means (not shown) engaging the mounting holes adjacent the rear surface. In accordance with the unique features set forth below, backboard 10 of the invention can be economically produced as an essentially waterproof structure, resisting the tendency to warp during prolonged periods of outdoor use.

To achieve economy in design, backboard 10 basically includes a substantially rigid substrate core member 15 (FIG. 1), such as plywood, particle board, or similar low cost constructive materials. Preferably, however, the core member 15 is fabricated from 'waterboard'. As used in the present specification, 'waferboard' is a reconstituted wood product consisting of wood chips bonded together with a water resistant resin, forming a subsantially rigid material. Because of the water resistant bonding resin, waferboard is desirable for outdoor use, due to its moisture resistant characteristics, preventing the material from warping. Waferboard is commonly sold in sheet form and is available from Louisiana Pacific Company, Hayward, Wis. In the present invention, the waferboard sheets are sawed into 3' by 4' blanks and then diecut with a forged ring die into the conventional backboard shape having a continuous upper rounded edge 17*a*, a pair of vertical side edges 17*b* and lower trapezoidal edges 17*c*, 17*d* and 17*e*.

Figure 3:
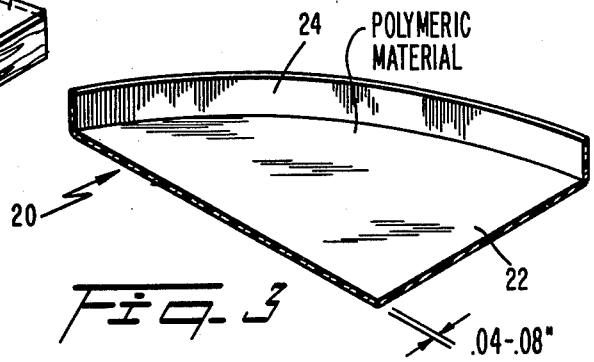
FIG. 3 is a partial perspective view of a first plastic shell member applied to the substrate core in the invention.
Figure 4:
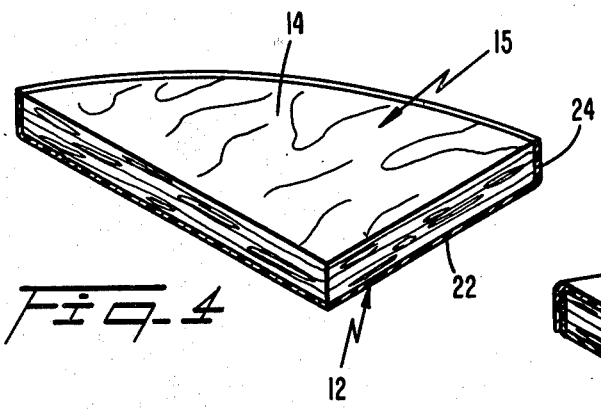
FIG. 4 is a view taken through the line 4—4 of FIG. 1 showing the positioning of the first plastic shell member in contacting engagement with the front surface and edges of the substrate core.

In the preferred embodiment of the invention, as shown in FIGS. 1–4, plastic shell member 20 is provided to cover the front surface of substrate 15 and adjacent peripheral edges 17*a*–17*e* thereof, to prevent moisture from entering the substrate core. As best shown in FIGS. 3 and 4, shell member 20 includes a substantially flat first portion 22 corresponding to the size of the front surface of substrate member 15. Second edge portions, generally designated with reference numeral 24, peripherally depend from the first portion 22 and correspond in size to edges 17*a*–17*e* of the substrate member for overlapping contact therewith, as shown in FIG. 4. Plastic shell member 20 is preferably formed from plastic material selected from the group consisting of polystyrene, polycarbonate, polyacrylates, polyethylene and polypropylene having a thickness in the approximate range of 0.04–0.08 inches. Any polymeric mateial may be used as the shell, provided it exhibits the characteristics described herein. Polystyrene is highly preferred. Polymeric materials of this type are commercially available. Since the edge portions 24 are integrally formed with and orthogonal to the flat portion 22 covering the front surface of substrate member 15, it will be appreciated that front surface 12 of backboard 10 and peripheral edges 17*a*–17*e* thereof are completely encapsulated by the first shell member 20 in a seamless manner, thereby preventing moisture from entering the substrate core 15 through the front surface 12 or the peripheral edges.

To join the plastic shell 20 and substrate 15 together, thereby sealing the front surface and the peripheral edges of the substrate from the external environment, a synthetic resin glue of approximately 2–3 ml. (wet thickness) is applied to the substrate with a glue spreader. One type of adhesive particularly suited for use in the present invention is available from Eschem Inc., as Adhesive No. 44252, and which contains approximately 46% solids.

After application of the synthetic resin glue to the front surface and the peripheral edges of substrate 15, the adhesive bearing surfaces of the substrate are positioned in contacting engagement with the corresponding surfaces of plastic shell 20. Using cold pressing techniques, pressure is applied to force the shell tightly against the substrate until the adhesive has cured properly to fasten the shell and substrate together in secure contacting engagement.

Mounting holes H can then be drilled through backboard 10, as discussed above. Rear surface 14 is then painted, preferably with a moisture resistant paint, to retard moisture penetration therethrough. A target area can then be silkscreened onto front surface 12 of backboard 10 and is allowed to cure prior to packaging.

The feature of encapsulating at least the front surface and the peripheral side edges of substrate 15 with molded plastic shell 20 advantageously provides for a strong and rigid structure that is pleasing in appearance when viewed by basketball players and spectators. Although the plastic shell 20 is relatively thin in comparison with prior known uses of relatively thicker and more expensive layers of fiberglass matte, the shell used in the present invention is of sufficient thickness to prevent telegraphing of depressions and protuberances appearing on the outer surface of the substrate to the outer surface 12 of the plastic shell, thereby enabling accurate silkscreen printing on the smooth front surface of the backboard while allowing the use of less expensive rough grade waferboard, particleboard and the like to form the substrate core. As discussed above, encapsulation of the front surface and the peripheral edges of the substrate core with plastic shell 20 effectively prevents moisture from entering the substrate through the sealed surfaces. Althrough moisture can be absorbed by the substrate through rear surface 14, it will be appreciated that painting of the rear surface advantageously serves to impede moisture penetration into the substrate. After prolonged use of backboard 10, when a sufficient amount of moisture has penetrated into substrate core 15 to induce swelling, it will be further appreciated that the feature of encapsulating only front surface 12 and edges 17 of the substrate within plastic shell 20 allows the swelling substrate to expand in the direction of its exposed rear surface. In this manner, rupture of the plastic shell is effectively prevented for continued, reliable use.

Figure 5:
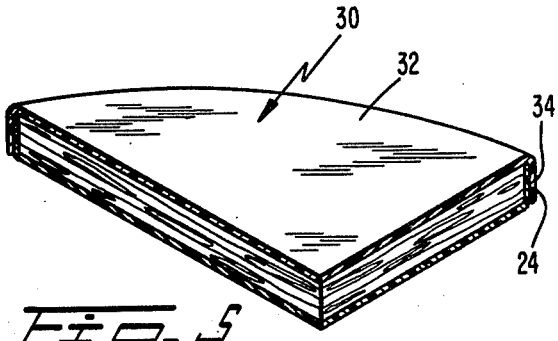
FIG. 5 is a partial perspective view showing a second embodiment of the present invention.

In a second preferred embodiment of the invention, a second plastic shell member 30 is provided to cover rear surface 14 of substrate member 15, thereby completely encapsulating the substrate within plastic. As shown in FIG. 5, second plastic shell 30 includes a substantially flat first portion 32 generally corresponding to, and of slightly larger size than, the rear surface 14 of substrate 15. Second edge portions 34 peripherally depend from the first portion 32 for adhesive contact against the outer surface of second edge portions 24. In the second embodiment, the feature of completely encapsulating substrate 15 within first and second shell members 20, 30 serves to completely isolate the substrate from the external environment, thereby further preventing moisture penetration into the substrate. In the event that moisture is absorbed by substrate 15, through mounting holes H, for example, sufficient to induce swelling, it will be appreciated that, as expansion occurs between the shells, the adhesive material between second edge portions 24, 34 will slightly yield to enable the second edge portions to slide in relation to each other in opposite directions to accomodate the swelling substrate, thereby preventing the backboard from rupturing.

In this disclosure, there are shown and described only the preferred embodiments of the invention, but, as aforementioned, it is to be understood that the invention is capable of use in various other combinations and environments and is capable of changes and modifications within the scope of the inventive concept as expressed herein.

EXAMPLE I

A molded plastic shell in accordance with the invention is formed from polystyrene which contains UV stabilizers, by initially extruding the polymer in sheet form. The plastic sheets are then rotary formed into the shape of a basketball backboard with depending peripheral edges. The edges are then sawed to the proper depth which corresponds to the edge thickness of the backboard.

Commercially available waferboard sheets are sawed to 3′ by 4′ blanks. The blanks are diecut with a forged ring die into basketball backboard shape. A synthetic resin glue is applied to the front surface and the peripheral edges of the waferboard with a glue spreader. The polystyrene shell and waferboard blank are joined together and cold pressed for approximately 30 minutes.

Mounting holes and holes for the basketball hoop are drilled through the backboard with conventional machining drills. The backboard rear surface is painted using roll coaters and cured with gas fired ovens. A target area is silkscreened onto the front surface of the backboard and is allowed to cure prior to packaging.

We claim:

1. A basketball backboard comprising:

(a) a substrate core member formed of a substantially flat rigid material of generally rectangular configuration having corresponding front and rear surfaces and peripheral edges therebetween, the rear surface being covered with a layer of paint;

(b) a rigid plastic shell member having a first portion dimensioned to cover the front surface of the substrate member and including peripheral edge portions integrally formed with and extending generally orthogonally from the first portion a distance equal to the thickness of the core to contact and cover the peripheral edges of the substrate without overlapping the rear surface; and (c) adhesive means for fastening the plastic shell member to the substrate member, the plastic shell and painted rear surface tending to retard penetration of moisture into the core.

2. A basketball backboard according to claim 1, wherein said substrate member is formed from a material consisting of reconstituted wood having wood chips bonded together with a water resistant resin forming the substantially rigid core.

3. A basketball backboard according to claim 2, wherein said plastic shell member is of sufficient thickness to prevent telegraphing of depressions and protuberances appearing in the outer surface of the substrate to the outer surface of the plastic shell member.

4. A basketball backboard according to claim 1, wherein said plastic shell member is formed from polymeric materials selected from the group consisting of polystyrene, polycarbonate, polyacrylates, polyethylene and polypropylene, the plastic shell member having a thickness in the approximate range of 0.04–0.08 inches.

5. A basketball backboard according to claim 1, wherein said fastening means is an adhesive bonding agent having a synthetic resin glue as a primary adhesive component.

6. The basketball backboard as claimed in claim 1, wherein said plastic shell member is premolded.

7. A basketball backboard comprising:

(a) a substrate core member formed of a substantially flat rigid material of generally rectangular configuration having corresponding front and rear surfaces and peripheral edges therebetween;

(b) a rigid, plastic shell member having a first portion dimensioned to cover the front surface of the substrate member using adhesive material and peripheral edge portions integrally formed with and extending generally orthogonally from the first portion a distance equal to the thickness of the core to contact and cover the peripheral edges of the substrate without overlapping the rear surface; and (c) a second plastic shell member having a first portion generally corresponding to and of slightly larger size than the rear surface of the substrate member and including edge portions extending peripherally and generally orthogonally from the first portion, said first portion of the second shell being in contact with the rear surface of the substrate using adhesive fastening means so that the edge portions of the second shell overlap the edge portions of the first shell in sealing engagement, thereby completely encapsulating the substrate member to isolate same from the external environment, said first and second plastic shell members each having a thickness in the approximate range of 0.04–0.08 inches.

8. The basketball backboard as claimed in claim 7, wherein said first and second plastic shell members are each premolded.

9. A basketball backboard comprising:

(a) a substrate core member formed of a substantially flat rigid material of generally rectangular configuration having corresponding front and rear surfaces and peripheral edges therebetween;

(b) a rigid plastic shell member having a first portion dimension to cover the front surface of the substrate member and including peripheral edge portions integrally formed with and extending generally orthogonally from the first portion a distance equal to the thickness of the core to contact and cover the peripheral edges of the substrate without overlapping the rear surface, said plastic shell member having a thickness in the approximate range of 0.04–0.08 inches, said plastic shell member tending to retard penetration of moisture into the substrate core while enabling said core to swell and expand in the direction of the rear surface of the core when a predetermined amount of moisture penetrates the core so that the plastic shell is thereby prevented from rupturing; and (c) adhesive means for fastening the plastic shell member to the substrate core member.

10. The basketball backboard as claimed in claim 9, wherein said plastic shell is premolded.

* * * * *